US007121317B2

(12) United States Patent
Mullet

(10) Patent No.: US 7,121,317 B2
(45) Date of Patent: Oct. 17, 2006

(54) SECTIONAL DOOR SYSTEM

(75) Inventor: Willis J. Mullet, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/713,871

(22) Filed: Nov. 14, 2003

(65) Prior Publication Data

US 2004/0103997 A1 Jun. 3, 2004

Related U.S. Application Data

(62) Division of application No. 10/132,864, filed on Apr. 24, 2002, now Pat. No. 6,951,237.

(51) Int. Cl.
*E05D 15/16* (2006.01)

(52) U.S. Cl. ..... 160/201; 160/229.1

(58) Field of Classification Search ..... 160/201, 160/133, 229.1, 218, 209, 220, 233, 235, 160/267; 49/383
See application file for complete search history.

(56) References Cited

U.S. PATENT DOCUMENTS

| | | | | |
|---|---|---|---|---|
| 3,941,180 | A * | 3/1976 | Thill | 160/229.1 |
| 3,992,845 | A | 11/1976 | Grzesiek et al. | 52/547 |
| 4,685,266 | A | 8/1987 | Mullet | 52/309.11 |
| 4,691,827 | A | 9/1987 | Grace et al. | 206/465 |
| 4,893,666 | A | 1/1990 | Hörmann | 160/229.1 |
| 5,002,114 | A * | 3/1991 | Hormann | 160/229.1 |
| 5,125,155 | A | 6/1992 | Kyle et al. | 29/897.32 |
| 5,129,441 | A | 7/1992 | Leist et al. | 160/229.1 |
| 5,133,108 | A * | 7/1992 | Esnault | 16/225 |
| 5,148,850 | A * | 9/1992 | Urbanick | 160/231.1 |
| 5,170,832 | A | 12/1992 | Wagner | 160/201 |
| 5,361,976 | A | 11/1994 | Blomfield | 229/148 |
| 5,435,108 | A | 7/1995 | Overholt et al. | 52/309.11 |
| 5,495,640 | A | 3/1996 | Mullet et al. | 16/97 |
| 5,555,923 | A | 9/1996 | Leist et al. | 160/229.1 |
| 5,782,283 | A | 7/1998 | Kendall | 160/229.1 |
| 5,862,912 | A | 1/1999 | Schelhorn | 206/321 |
| 5,869,353 | A | 2/1999 | Levy et al. | 438/109 |
| 5,915,444 | A * | 6/1999 | Sastri et al. | 160/229.1 |
| 5,927,369 | A * | 7/1999 | Pedersen | 160/201 |
| 6,006,817 | A * | 12/1999 | Stone et al. | 160/201 |
| 6,076,590 | A * | 6/2000 | Ford et al. | 160/229.1 |
| 6,315,027 | B1 | 11/2001 | Lichy | 160/205 |
| 6,317,915 | B1 | 11/2001 | Grearson | 14/73 |
| 6,328,091 | B1 | 12/2001 | Whitley | 160/201 |
| 6,408,926 | B1 | 6/2002 | Hoofard et al. | 160/236 |

(Continued)

FOREIGN PATENT DOCUMENTS

| | | | |
|---|---|---|---|
| EP | 0 728 897 | A | 8/1996 |

(Continued)

*Primary Examiner*—David Purol
(74) *Attorney, Agent, or Firm*—Renner Kenner Greive Bobak Taylor & Weber

(57) ABSTRACT

A sectional door including, a plurality of panels pivotally joined to each other, the panels including a facer having a front surface, a first joint member and a second joint member extending rearwardly of the facer, a pair of end stiles received at lateral extremities of the panels and placed in supporting relation thereto, the stiles having a recess adjacent one of the joint member, a hinge receiver located adjacent the recess and a hinge pivotally coupled to one of the panels at the hinge receiver and fastened to another of the panels at the end stile, wherein the recess provides a clearance for pivoting movement of the hinge and the storage or stowage of door components.

20 Claims, 10 Drawing Sheets

U.S. PATENT DOCUMENTS

| | | | | |
|---|---|---|---|---|
| 6,493,995 | B1 | 12/2002 | McKenzie | 52/36.4 |
| 6,527,036 | B1 * | 3/2003 | Welsh | 160/201 |
| 6,553,618 | B1 * | 4/2003 | Whitley | 16/91 |
| 6,586,085 | B1 * | 7/2003 | Jella | 428/319.1 |
| 6,626,226 | B1 | 9/2003 | Whitley | 160/236 |
| 6,627,987 | B1 | 9/2003 | Glenn et al. | 257/704 |
| 6,648,052 | B1 * | 11/2003 | Marzari Chiesa et al. | 160/201 |
| 2002/0089269 | A1 | 7/2002 | Hightower | 312/236 |
| 2002/0170687 | A1 * | 11/2002 | Wright | 160/229.1 |
| 2002/0179256 | A1 * | 12/2002 | Leist et al. | 160/201 |
| 2004/0103997 | A1 | 6/2004 | Mullet | 160/201 |

FOREIGN PATENT DOCUMENTS

| | | |
|---|---|---|
| EP | 1 076 149 A | 2/2001 |
| WO | WO 99/50522 | 10/1999 |
| WO | WO 01/02684 A | 1/2001 |

* cited by examiner

SECTIONAL DOOR SYSTEM

This application is a divisional of U.S. Ser. No. 10/132,864, filed on Apr. 24, 2002 now U.S. Pat. No. 6,951,237. 37 C.F.R. § 1.78(a)(2)

TECHNICAL FIELD

The present invention relates generally to upward acting sectional door systems. More particularly, the present invention relates to an insulated or noninsulated sectional door having a single leaf hinge and a pinch-resistant section to section interface of the door panels. The track system and counterbalance system drive tube for the door system are receivable within the door sections, thereby requiring no additional space for shipping.

BACKGROUND ART

Upwardly acting sectional doors have become commonplace in a variety of applications including buildings, trucks, and trailers. These doors are characterized by a plurality of hinged sections or panels that articulate in a pivoting fashion as the door is moved from a generally vertical, closed position to a horizontal, open position. Attendant to the pivoting of door sections is the risk of entrapment between those sections, which has led to the development of a number of pinch-resistant designs. Such doors are formed with section interfaces that eliminate the finger and/or hand entrapping gaps that otherwise might open and close as the sections articulate.

In one such door, mutually facing convex and concave curved surfaces are formed across the lateral width of the door. During the transition from the closed door condition to the stowed open door condition, the space between these surfaces is dictated by the hinge between the panels, which causes the facing sides to shift in relation to each other as they articulate around their associated axes. This space remains during articulation of the door section, but decreases along the direction of articulation during at least a part of the transition into the state of maximum articulation to reduce the likelihood of a foreign object entering the gap and becoming pinched between the sections.

In another system, the hinged door panels are provided, at their facing edges, with areas that curve around the axis of the hinges to eliminate the occurrence of a gap, as wide as a finger, at any angle between the panels. When the door is in a closed state, shoulder areas engage each other in the vicinity of the interior surface of the door and outside the curved edge areas that extend from the outer surface of the door.

In yet another door system, male and female portions are formed on an adjacent garage door panels to cooperate with each other in such a manner so as to minimize the gap therebetween, thereby protecting human fingers from being pinched by both the inside and outside of the garage door. Each panel is securely fastened to a structural member, which supports the weight of the panel. Adjacent structural members are vertically aligned with one another and coupled together by a hinge pin and hinge sleeve. Each structural member cooperates with an adjacent hinge sleeve so as to prevent human fingers from being pinched by the inside of the garage door.

In still another door system, known in the industry, a plurality of panels are pivotally connected to one another with mating upper and lower edges of the adjacent panel providing a pinch-resistant configuration during the articulation of the door. In this door, assembly and installation are more easily and efficiently accomplished, because the door panels provide contact locations between mating upper and lower edges of the panels. The configuration of these contact locations aligns the panels relative to one another during installation. Additionally, the hinge assembly includes a pivot axis which is positioned between the front and back faces of the panel to enhance the pinch-resistant operation of the door.

When installing a sectional door, the sections or panels are generally stacked in the opening and temporarily retained by nails or other suitable fasteners until the hinges are installed. Then, roller stems are placed in the roller carriers and the track system is installed over the rollers and attached to the frame around the opening. To facilitate stacking, the prior art teaches that the panel to panel interfaces on the door sections must have load-bearing surfaces. These load-bearing surfaces are normally somewhat flat and perpendicular to the face of the panel to carry a substantial portion of the weight of the stacked panels. Further, the panel to panel interface must align the panels with each other and prevent the panels from moving either in or out during installation of the hinges, rollers and the track system. For proper operation, these considerations need to be met, and the panels need to articulate proximate to each other during the normal operation of the door without rubbing or abrading or opening a gap sufficient to insert a finger or hand. As mentioned, one solution is to manufacture panel to panel interfaces that position the panels during installation using a hinge to raise the panel and define the clearance therebetween. Unfortunately, manufacturing tolerances and variances make this method troublesome. In most cases, the door sections are connected with hinges, which include a roller stem carrier formed integrally with a hinge. Thus, as described above, the hinge is installed prior to insertion of the rollers and before the stacked panels can be supported by a track system. While this improves the panel spacing in the interface area, as the panels get larger and heavier it becomes more difficult to insert the hinges.

Typically, the hinges have two leaves and a hinge pin, which becomes the pivot point of the hinge and holds the leaves together. It is known to have part of each leaf arranged to form a knuckle so that the hinge pin is not required. Ordinarily, the hinges are attached to the panels with fasteners such as screws driven into the panel itself or a component of the panel such as a stile. In some prior-art hinges, the hinge serves as the roller carrier and accepts the roller pin. In these single-leaf designs, the hinge pin is used to attach the hinge leaf to the stile. In either of the above-described designs, the roller location must remain constant to the lower panel or undesired movement of the panels through the transitional radius will occur.

The door sections are normally packaged for shipment by bundling in pairs or four section packs. The counterbalance system, track system, and remaining hardware are packaged separately in one or more additional packages. These packages that are separate from the panel packages are different in size leaving undesirable voids in the shipping container as well as the possibility of missing components, when the door components are delivered to the job site. One solution, in the industry, was to bundle similar components together to minimize lost space. Unfortunately, the components needed to be separated at the shipment termination requiring additional time to prepare the door for installation. Further, this did not relieve the possibility of components being lost during shipment and additional handling of components. In some instances, the door panels are constructed of component parts such that the panels, track, and counterbalance system could be broken down and packaged together. While reducing the number of lost parts, handling and storage or stowage become a significantly greater burden.

SUMMARY OF THE INVENTION

In light of the foregoing, it is an object of the present invention to provide a door panel interface formed integrally in adjacent panels, where the interface bears a portion of the weight of the door and performs a pinch-resisting function. It is another object of the present invention to provide an overhead sectional door having a plurality of panels, each panel having a rearwardly extending interface, where a portion of the weight of a superjacent section is borne by a portion of a subjacent section at the front surface and at an intermediate point of the interface between the front and rear of the panel. Yet another object of the present invention, is to provide a joint surface on the subjacent section carrying a raised portion intermediate of the front plane and rear plane that bears a portion of the weight of the superjacent section and prevents intrusion of foreign objects during articulation of the door sections. Still another object of the present invention, is to provide an overhead sectional door where the joint surfaces of adjacent sections are adapted to pivot with respect to each other through a range of motion as the door is moved from a generally closed vertical position to a generally open horizontal position, where a raised portion of the joint assemblies remains in proximity to the opposite joint surface through a portion of the range of motion to prevent intrusion by foreign objects.

Another object of the present invention, is to provide a sectional door where the bearing surface of the joint interface is oriented to bear the weight of the door. Still another object of the present invention, is to provide a joint interface having a bearing portion located intermediate of the front and rear faces of a door section. Yet another object of the present invention is to provide a bearing position that facilitates pivotal movement between adjacent door sections. It is still another object of the present invention to provide a raised bearing portion on a joint surface in the interface that contacts an opposite joint surface where the raised portion slopes downward toward the rear of the door section.

Another object of the present invention is to provide a sectional door that carries the door rollers independently of the hinges between adjacent panels. A further object of the present invention is to provide a roller receiver formed in a door section adjacent to the joint interface. Still a further object of the present invention, is to provide a roller carrier located between the front and rear surfaces of a door section which takes up less interior space when the door is closed and provides more headroom when the door is open and minimizes back break between the top panel and its adjacent panel in the open, horizontal position. Yet another object of the present invention is to provide an end stile inserted within the contours of a door section providing additional support thereto, where the roller carrier is carried by the end stile. Still another object of the present invention is to provide a carrier block insertably received within the end stile, where the carrier block holds the roller and may be non-metallic to reduce noise.

Another object of the present invention is to provide a door system that can be packaged for shipment where the track system and drive tube fit within the door sections, thereby requiring no additional room for shipping and reducing the instance of lost components. A further object of the present invention is to provide component receivers formed on the door sections to stow components including the track system and drive tube for packaging and shipping purposes. Still a further object of the present invention is to provide such component receivers formed in the stiles of a door section.

Another object of the present invention is to provide an overhead sectional door having a single leaf hinge joining adjacent sections. A further object of the present invention is to provide a single leaf hinge that may be attached to a door section before the sections are joined together. Yet another object of the present invention is to provide a single leaf hinge that allows the hinge leaf to remain attached to a first section in a position outside the normal movement of the hinge during operation until such time as the installer desires to attach the leaf to the second section. A further object of the invention is to provide such a single leaf hinge having a curl which interfits with a panel stile at one end and attaches by fasteners to the stile of an adjacent panel of a door for quick, easy installation.

Another object of the present invention is to provide an overhead sectional door having a cable attachment assembly at the bottom of the door that serves as a roller carrier for the bottom roller. Still another object of the present invention is to provide a cable attachment assembly that includes a bore adapted to receive the shaft of a roller constituting the bottom roller of the door, thereby eliminating a bottom bracket and fasteners.

The present invention generally contemplates a sectional door including, a plurality of panels pivotally joined to each other, the panels including, a facer having a front surface, a first joint member and a second joint member extending rearwardly of the facer, a pair of end stiles received at lateral extremities of the panels and placed in supporting relation thereto, the stiles having a recess adjacent one of the joint members, a hinge receiver located adjacent the recess and a hinge pivotally coupled to one of the panels at the hinge receiver and fastened to another of the panels at the end stile, wherein the recess provides a clearance for pivoting movement of the hinge and the storage or stowage of door components.

DETAILED DESCRIPTION OF THE INVENTION

Figure 1:
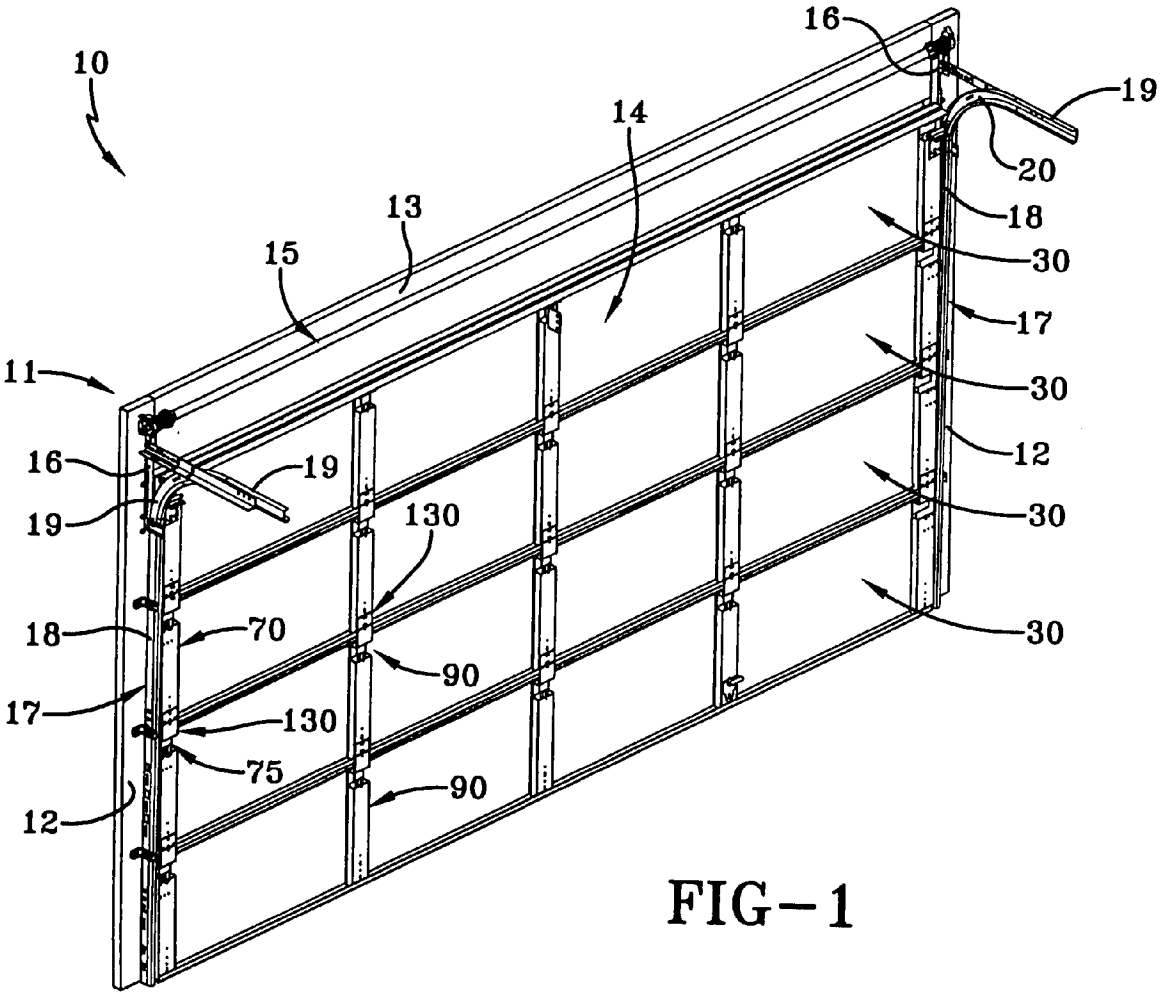
FIG. 1 is a fragmentary rear perspective view of an overhead sectional door system according to the concepts of the present invention depicting a plurality of door sections shown in conjunction with a track system and counterbalance system.

An upward acting insulated or uninsulated sectional door system embodying the concepts of present invention is generally indicated by the numeral 10 in FIG. 1 of the drawings. The door system 10 is positioned and mounted for opening and closing movement in a building, trailer or other structure by a peripheral door frame, generally indicated by the numeral 11. The frame 11 consists of a pair of spaced vertical jambs 12, that, as seen in FIG. 1, are generally parallel and extend vertically upwardly relative to a supporting surface such as the ground, a floor, or the bed of a trailer (not shown). The vertical jambs 12, 12 are spaced and joined proximate their vertical upper extremity as by a header 13 to thereby define the generally inverted U-shaped frame 11 for mounting a door, generally indicated by the numeral 14. The frame 11 may be constructed of wood, metal, or other relatively high-strength, rigid material for purposes of reinforcement, attachment to a building or vehicle, and facilitating the attachment of elements involved in supporting and controlling the door 14.

The header 13 may advantageously mount a counterbalance system, generally indicated by the numeral 15 that interacts with the door 14 to facilitate raising and lowering of the door 14 in a manner well known to persons skilled in the art. The counterbalance system 15 may be in accordance with the characteristics of a counterbalance system according to Applicant's Assignee's U.S. Pat. No. 5,419,010, which is shown for exemplary purposes and the disclosure therein incorporated herein by reference. It will be appreciated that any of a variety of counterbalancing systems may be employed.

Figure 2:
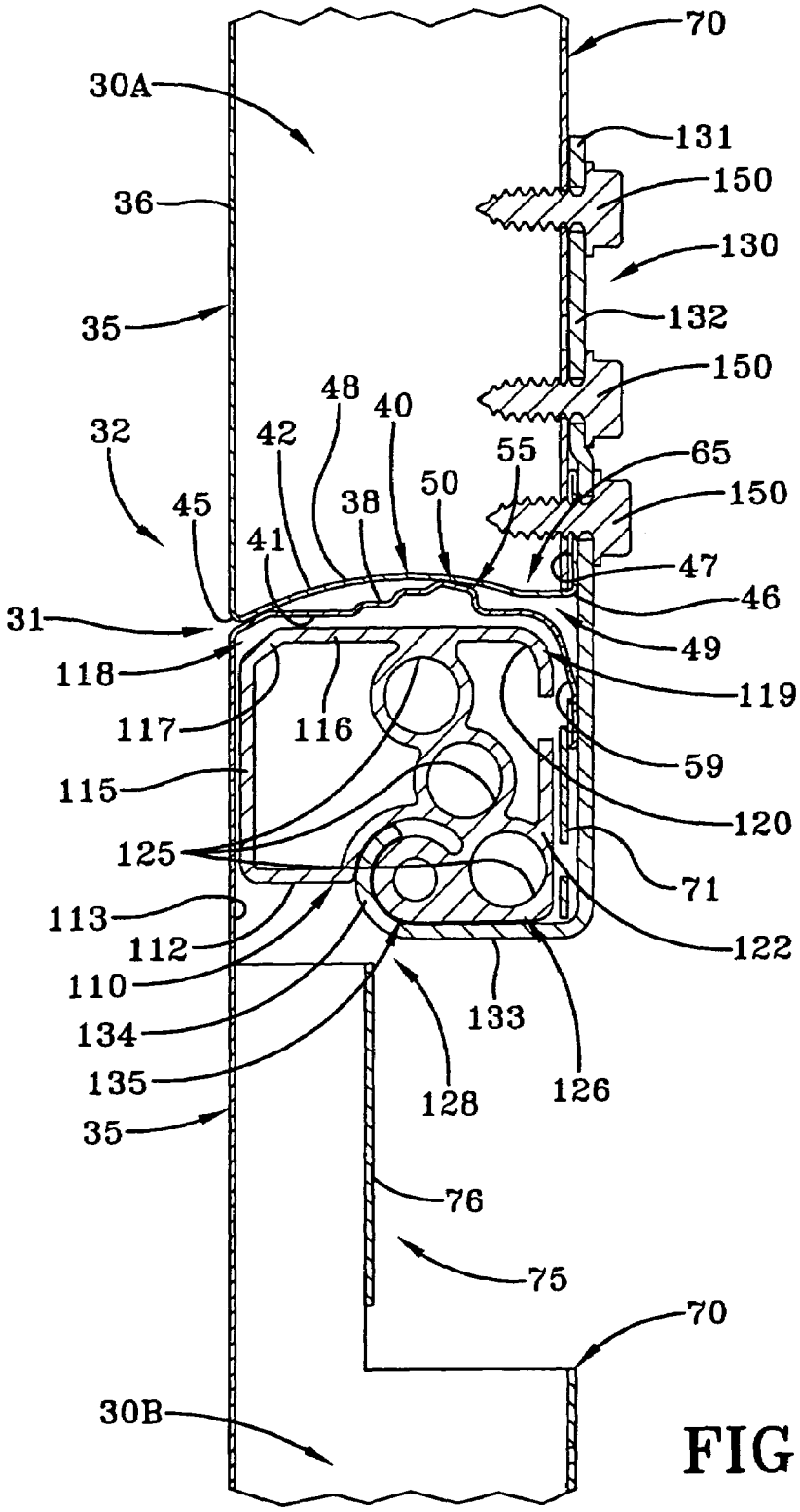
FIG. 2 is a fragmentary sectional view taken substantially along line 2—2 in FIG. 1A depicting details of the hinge, roller carrier, and joint assemblies between adjacent panels in the end stile area.

As seen in FIGS. 1 and 2, flag angles 16 mounted on frame 11 are provided to partially support roller track assemblies, generally indicated by the numerals 17, 17, which are positioned to either side of the door 14. Each of the roller track assemblies 17, 17 includes a vertical track section 18, a horizontal track section 19, and a transition track section 20 interposed therebetween. As shown, transition track sections 20, 20 may be made integral with horizontal track sections 19, 19 such that the sections 19, 20 may be decoupled, as a unit, from vertical section 18 for storage or stowage and transport as described below.

Figure 6A:
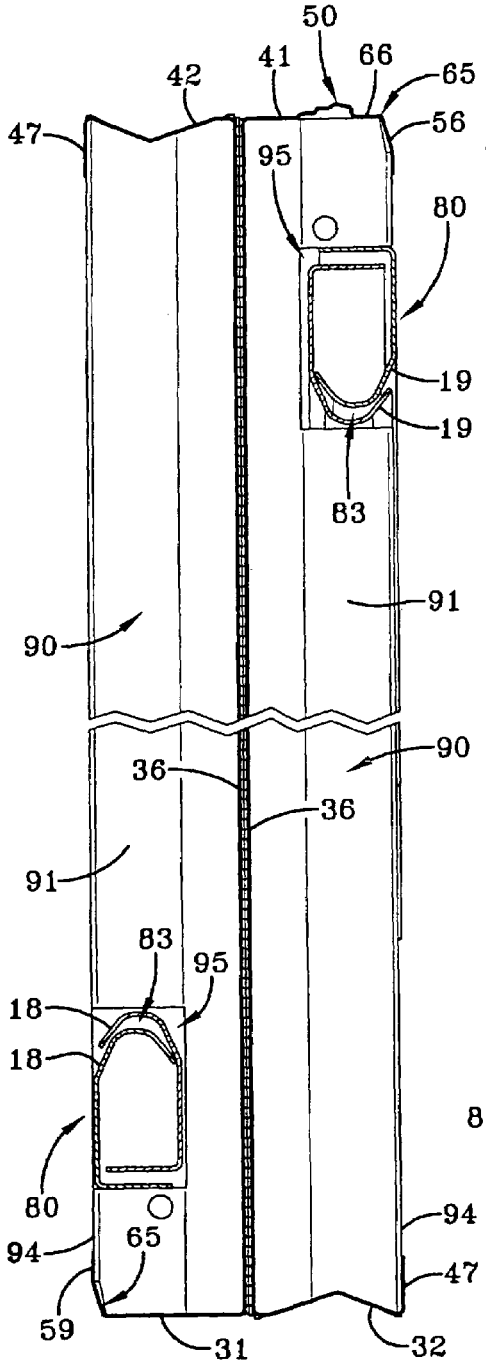
FIG. 6A is a fragmentary side elevational view of a pair of panels, as might be seen along line 6A—6A in FIG. 5, depicting receipt of track members within the component receiver assemblies formed on the sections.

The roller track assemblies 17, 17 may thus support and direct travel of the door 14 in moving from the closed vertical position, depicted in FIG. 1, associated with vertical track sections 18, 18 of roller track assemblies 17, 17 through transition track sections 20, 20 to an open, horizontal position associated with horizontal track sections 19, 19. The ends of horizontal track sections 19, 19 displaced from the door 14 are joined and supported by back bars (not shown) attached directly or indirectly to the ceiling or walls of a structure in which the door system 10 is installed. It will be appreciated that the door system 10 of FIG. 1 may be packaged for shipping with the back bar and horizontal track sections 19, 19 disassembled and positioned as depicted in FIG. 6A of the drawings, and described more completely below.

A four-panel sectional door 14 is shown for exemplary purposes in FIG. 1 of the drawings. However, it will be appreciated that additional panels may be employed in sectional doors of this type depending upon the height of the door opening, the width of the panels, and related considerations. As depicted, the door 14 has a plurality of panels or sections, generally indicated by the numeral 30. Each of the panels 30 has generally the same configuration, and thus for exemplary purposes, only a single panel 30 will be discussed in detail.

As shown in FIG. 2, door system 10 has a type of pan door 14 that has as a primary structural member a facer, generally indicated by the numeral 35, having a front surface 36 which may be essentially planar and extend substantially the height and width of panel 30. Joint assemblies, generally indicated by the numeral 40, extend rearward of front surface 36 at the top 31 and bottom 32 of panel 30. Joint assemblies 40 may include a first joint member 41 and a second joint member 42 shown, as an example, at the top and bottom 31 and 32, respectively, of the facer 35. Stacking of panels 30 in the vertical, closed configuration of door 14, depicted in FIG. 1, causes respective first and second joint members 41, 42 on adjacent panels 30 to mate to form an interface, generally indicated by the numeral 38 in FIG. 2 between adjacent panels. At the juncture of facer 35 and first joint member 41, facer 35 transcends into an upwardly sloping shoulder portion 44 defining an offset that provides a seat for a projecting nose 45 formed between the front surface 36 and the second joint member 42 on a superjacent panel 30A. In this respect, when adjacent panels 30A, 30B are in a planar orientation, as when the door 14 is in a closed position (FIG. 1), the nose 45 laps over the shoulder 44, in sealing relation of adjacent panels 30 at interface 38. This cooperative engagement of the nose 45 and shoulder 44 also aids in reinforcing panels 30 in their resistance to wind loads.

The second joint member 42 of panel 30A transcends a generally semicircular arc 48 extending from the nose 45 to a heel 46 formed between the second joint member 42 and tab 47 extending inwardly relative to the joint member 42 in a direction generally parallel to facer 35 and constituting the lower rear surface of panel 30. The tab 47 may have a return hem 47' to impart additional strength and rigidity to the panels 30. Heel portion 46 may be planar, as shown in FIG. 2, or transcend a downwardly projecting arc similar to nose 45. In either case, heel portion 46 provides a clearance at 49 for the first joint member 41 throughout its range of motion.

First joint member 41 may include a raised portion, generally indicated by the numeral 50, received within the umbrella of second joint member 42 and generally intermediate of the nose 45 and heel 46 thereof. The raised portion 50 may extend the entire length of panel 30, or as will be appreciated, may be provided at one or more portions of the top surface of the panel 30. Raised portion 50 extends upwardly to an extent necessary to contact second joint member 42, when the panels 30 are oriented in a planar vertical position associated with the closed door condition, as shown in FIG. 2.

Figure 2A:
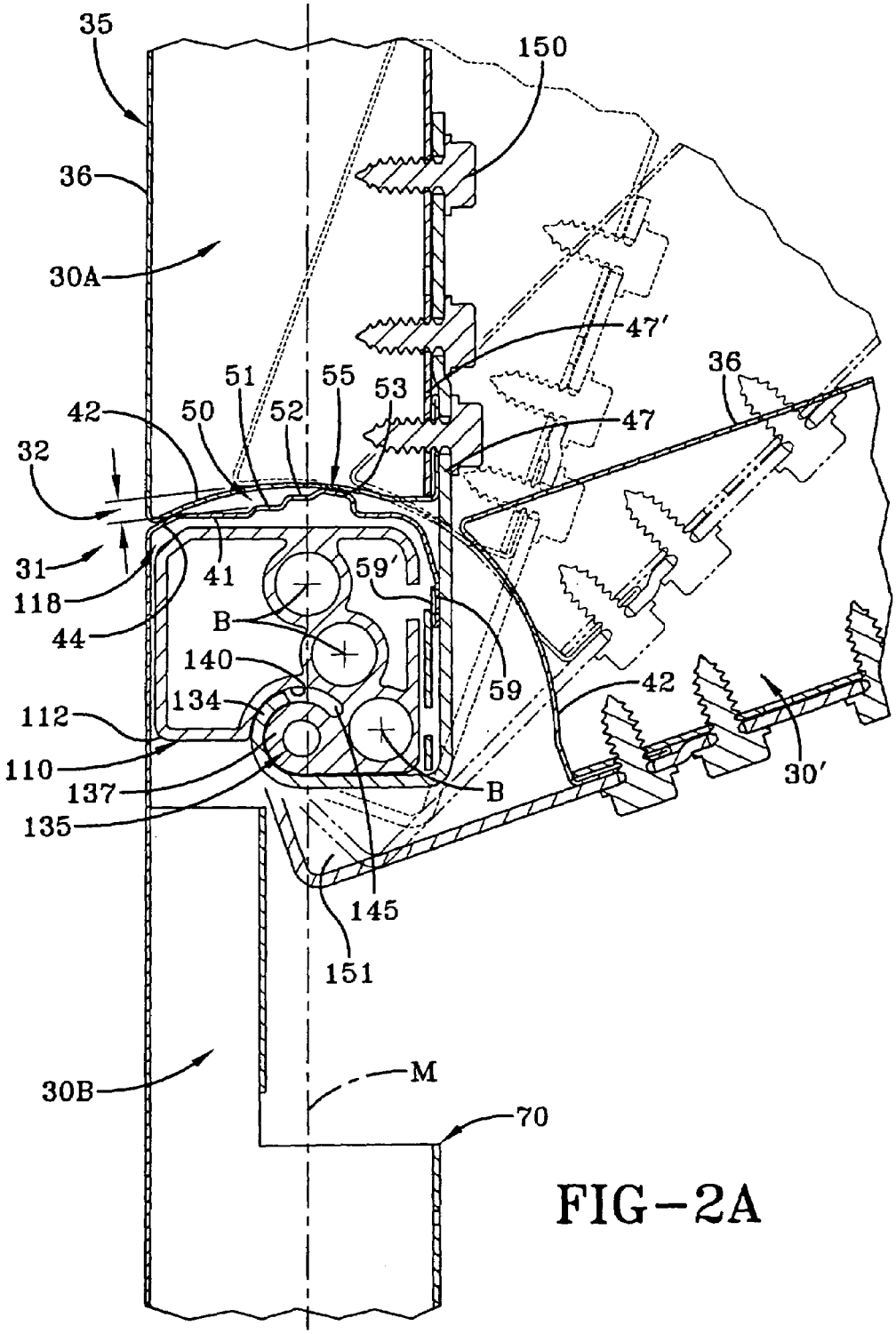
FIG. 2A is a fragmentary sectional view similar to FIG. 2 showing the adjacent panels at a plurality of different angular positions during movement of the door between the open and closed positions.

Raised portion 50 may be integrally formed in first joint member 41, as by the first joint member 41 transcending an upwardly extending profile, which may be gradual or include a stepped increase in the height of the first joint member 41 defining a raised portion 50 having one or more tiers. In the embodiment shown in FIG. 2A, a multi-tiered structure may include a first tier 51; a second tier 52 extending upwardly from the first tier 51; and a third tier 53, which is, in this example, the uppermost tier, extending upward from the second tier 52. Third tier 53 may have a generally planar top surface 54 (FIG. 3), which may contact the second joint member 42 in substantially a medial position relative to the front facer 36 and rear tab 47. The area of contact, generally indicated by the numeral 55, between the first joint member 41 and second joint member 42 at raised portion 50 may be located at any intermediate point on first joint surface 41, such as, a point just rearward of the midline M, as shown in FIG. 2A.

Figure 3:
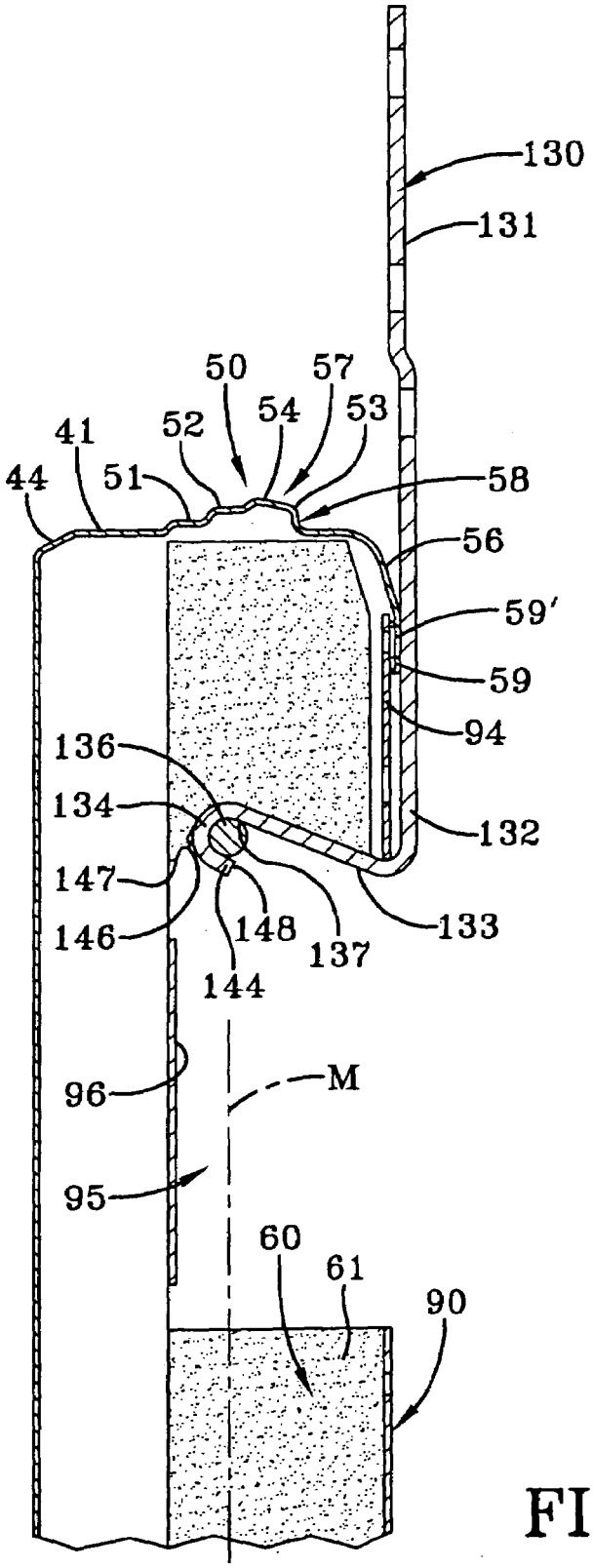
FIG. 3 is a fragmentary sectional side elevational view taken substantially along line 3—3 of FIG. 1A of a single door section and center stile depicting further details of the hinge assembly thereat.

To facilitate contact between the raised portion 50 and second joint member 42 when the door panels 30 are in the closed position, the top surface 54 of raised portion 50 may be given a slope at 57, as shown in FIG. 3, so that planar top surface 54 is substantially tangential to arc 48 of second joint member 42 at the contact area. From uppermost tier 53, first joint member 41 descends at 58 to substantially its initial level. As at the front surface 35 of panel 30, first joint member 41 may define an offset to provide a clearance for free relative rotation between adjacent panels 30. For example, first joint member 41 may extend downward and rearward in a linear fashion forming a sloped offset surface 56 that bridges first joint member 41 and tab 59 extending generally parallel to facer 35 and constituting the upper rear 48 of panel 30. The tab 59 may have a return hem 59' to impart additional strength and rigidity to the panels 30.

If desired, to reduce temperature transfer through the door 14 and/or to reduce noise transmission, insulating material, generally indicated by the numeral 60, may be carried or formed on or within panels 30, as shown in FIG. 3. The insulating material 60 includes a foam body 61 which may be of any of a variety of polyurethane or polystyrene foaming materials commonly employed in the insulation of garage doors and the like.

Figure 1A:
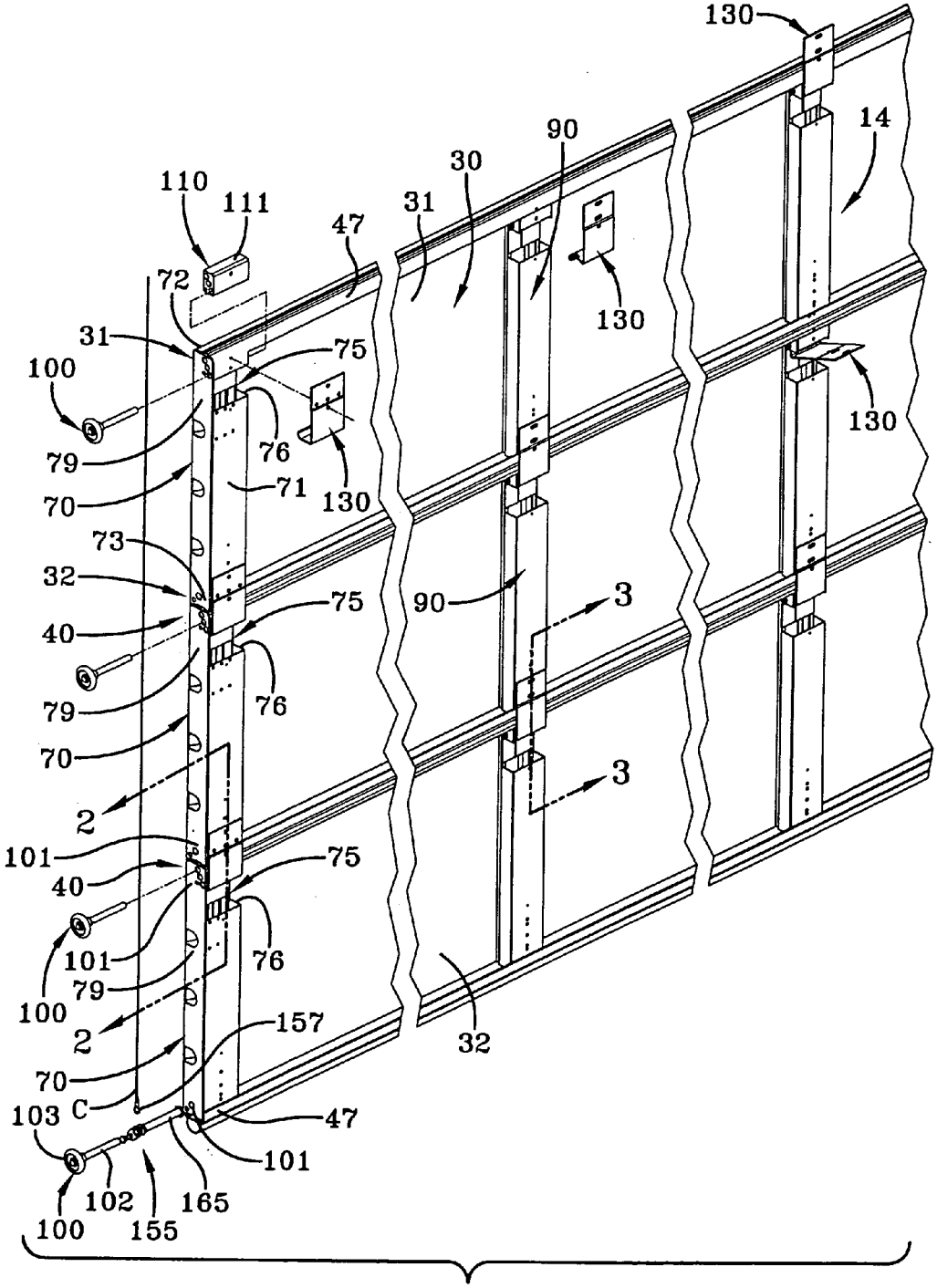
FIG. 1A is an enlarged fragmentary perspective view of the sectional door of FIG. 1 with some components depicted in exploded positions to show the interrelationship between various of the components and the structure thereof.
Figure 4:
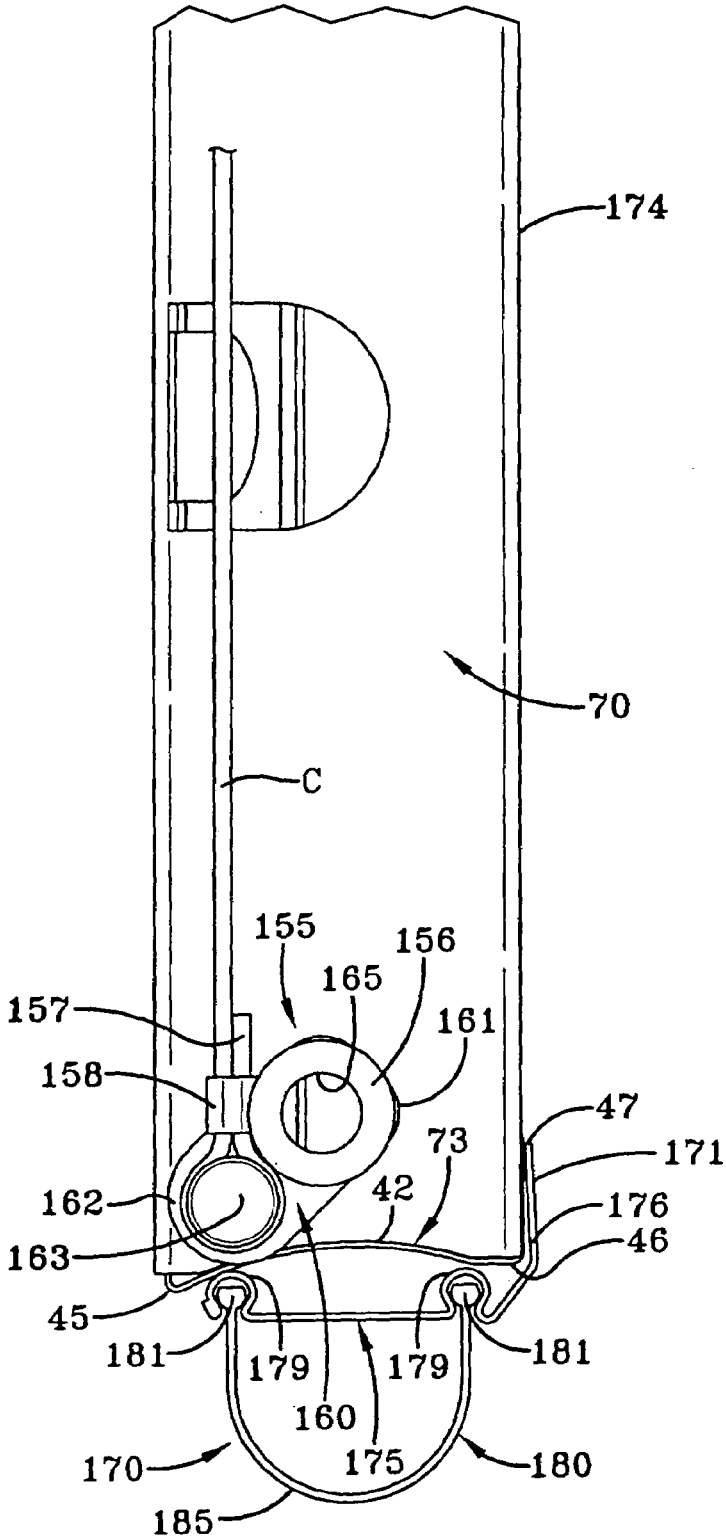
FIG. 4 is a fragmentary side elevational view of the bottom section of the door depicting details of a cable attachment assembly having an integrally formed roller receiver and further depicting details of the astragal assembly protecting the lower portion of the bottom section.

To help support the door 14 and improve its rigidity, various vertical support members, such as stiles may be used in connection with the door panel 30. For example, end stiles, generally indicated by the numeral 70, may be located at the lateral extremities of panels 30. If necessary or desirable, one or more center stiles, generally indicated by the numeral 90 and described more completely below, may be located intermediate of the lateral extremities of panels 30. The end stiles 70, are generally elongate members that extend between the top 31 and bottom 32 of the panels 30. Stiles 70, 90 are adapted to fit within the confines of panels 30 and may be retained within facer 35 by the inwardly extending tabs 47, 59 located at the top 31 and bottom 32 of panel 30. End stile 70 generally includes a stile body 71, which may be hollow and have a box-like section. As shown in FIG. 1A, stile body 71 may be contoured at its top 72 and bottom 73 to substantially conform to the joint surfaces 41, 42 of the panels 30 and provide additional support thereto. For example, as shown in FIG. 4, the bottom 73 of an end stile 70 is made arcuate near its center to conform somewhat to the arcuate shape of the second joint member 42. Similarly, the end stiles 70 may be provided with sloping portions at 65 (FIG. 6A) that conform to the sloped surfaces 56 of facer 35. The top surface 66 of stile 70 may be truncated such that the raised portion 50 of first joint member 51 extends beyond the top surface 65, as shown, for example, in FIG. 6A.

Figure 5:
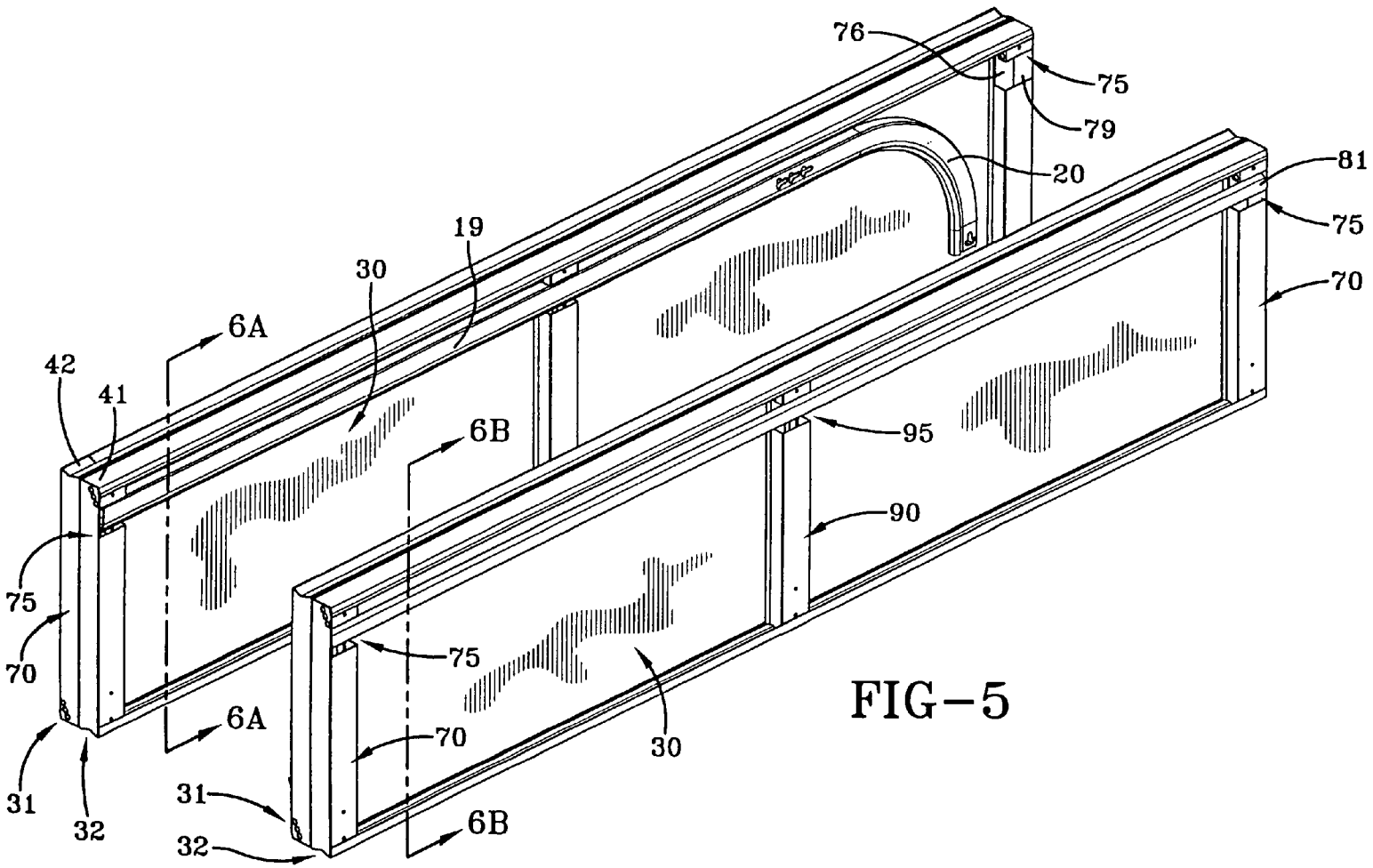
FIG. 5 is a perspective view of two pairs of door sections disassembled and facing each other with the rear surfaces of the panels exposed depicting details of component receiver assemblies formed on the rear side of the sections showing vertical track members located on one panel in a pair of panels and a drive tube located on a second panel in a second pair of panels.
Figure 5A:
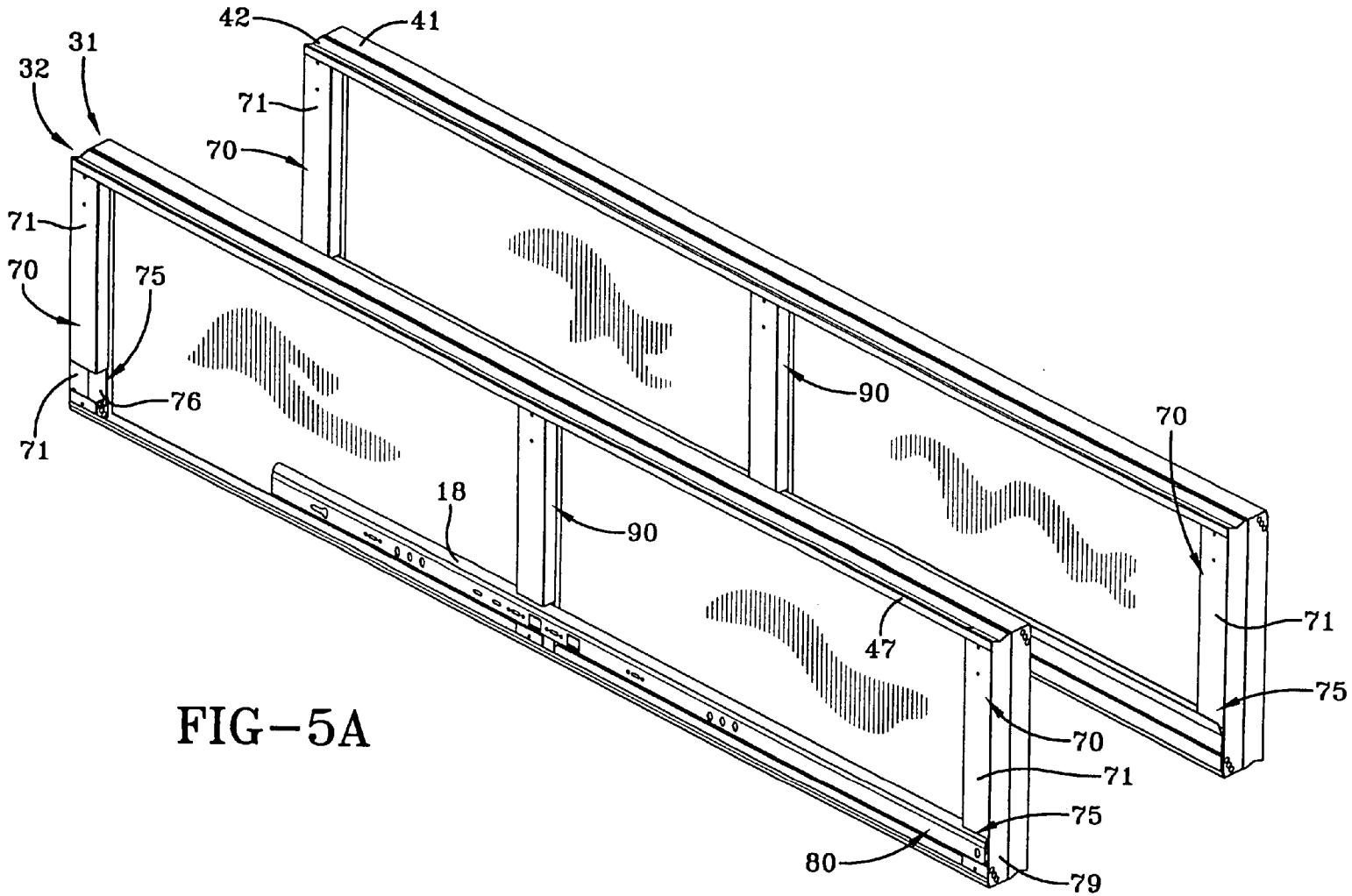
FIG. 5A is a perspective view of the panels depicted in FIG. 5 rotated 180° to show details of the second panel in each pair including component receiver assemblies for storage or stowage of horizontal track sections and cross members therein.
Figure 6B:
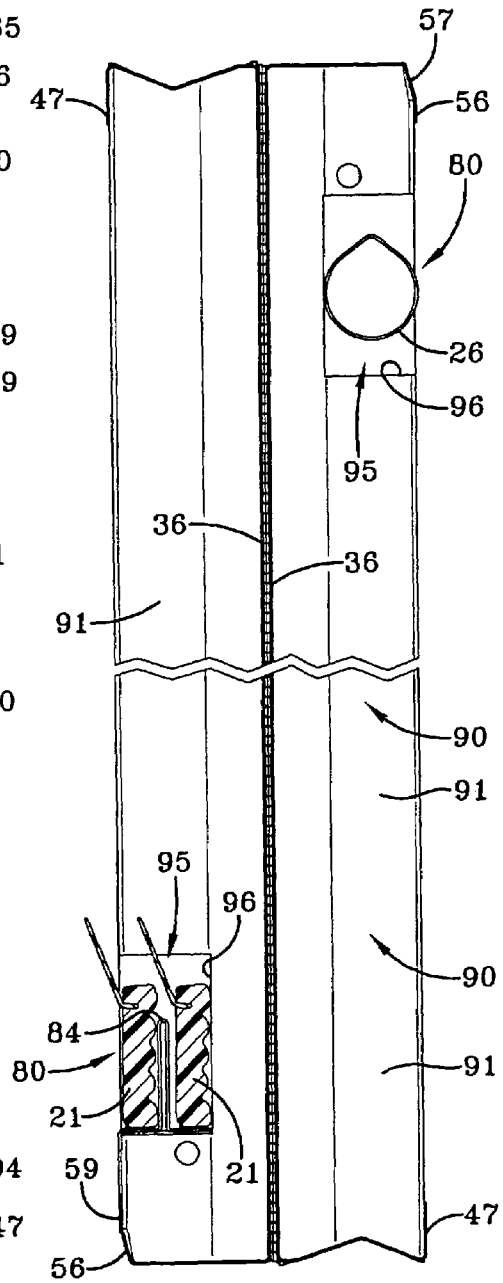
FIG. 6B is a partially fragmented side elevational view similar to FIG. 6A, as might be seen along line 6B—6B in FIG. 5, depicting receipt of a counterbalance drive tube and door stop pieces within the component receiver assemblies located on respective panels.

In accordance with another feature of the present invention, stiles 70, may be provided with storage receivers, generally indicated by the numeral 75 in FIGS. 5 and 5A, that may be used to carry track members 17, drive tube 26, or other door components, collectively and individually indicated by the numeral 80 in FIGS. 6A and 6B, during transport of the door system 10. Receivers 75 may take the form of various brackets or other devices attached to the panels 30 or end stiles 70 or, as shown, the receivers 75 may take the form of one or more notches or recesses 76 sized to receive door system components 80 within the body 71 of end stiles 70 (FIG. 2). As shown, recesses 76 may be formed in stiles 70, 90, as necessary to retain the door components 80. Recesses 76 may be capped at their lateral outward extremity to at least partially enclose an end 81 of a stored component 80, as by a band of material forming the outbound lateral side 79 of end stile 70 (FIG. 1A). If necessary to accommodate door components 80 having a lateral dimension greater than that of the door 14, the capping member may protrude laterally outward of the edges of door 14. It will be appreciated that such members may be made removable, when their outward extension would interfere with operation of the door 14.

In the example shown, recess 76 is a box-shaped cut out formed in stiles 70. As mentioned the outbound lateral side 79 of end stiles 70 may close the recess 76 formed in end stile 70 on one side. As shown in FIGS. 2 and 2A, recess 76 may only partially extend into the thickness of end stile 70 leaving space for the installation of insulating material. The number of receivers 75 per panel 30 may vary depending on the desire to attach one or more components to a door panel 30. For example, as shown in FIGS. 5, 5A, 6A and 6B, in a four panel door system, only a single receiver 75 on each panel 30 is necessary to stow the vertical tracks 18, 18, horizontal tracks 19, 19, door stop pieces 21, 21, and counterbalance drive tube 26. The vertical and horizontal tracks 18, 19 may be arranged one within the other in an overlapping configuration, shown at 83 in FIG. 6A, and then fit within the receivers 75 on a panel 30. Similarly, the door stop pieces may be arranged adjacent to each other in a single receiver 75. As shown in FIG. 6B, receiver 75 may be provided with a divider 84 to separate multiple stored components 80 within a single receiver 75. As multiple components are stowed in receiver 75, divider 84 serves to hold inserted components 80 in the proper position, avoiding any interference from previously stowed components as additional components are stowed within a receiver 75. Since generally only a single drive tube 26 is used, it may be located by itself in a single receiver 75 formed on panel 30. For convenient packaging, pairs of panels 30 may be oriented back-to-back with their respective receivers 75 facing outward to give packaging personnel and the end-user access to the components 80 stored thereon.

The recesses 76 may be formed such that they closely fit the stored components 80 that are to be received therein or, if desirable, create an interference fit, such that, the stored components 80 may be snap fit and held within the receivers 75 by virtue of the fit therebetween. Recesses 76, further, may be contoured or provided with contoured inserts that conform to specific components 80, facilitating accurate packaging of door components 80, and, thus, helping to ensure that all of the necessary components 80 arrive on-site in a single package.

The center stiles 90, which may be similar to end stiles 70, are provided at one or more locations intermediate the end stiles 70. Since center stile 90 is similar to end stile 70, like numbers will be used to describe like portions of center stile 90. A single center stile 90 may be used, and it may be located at any point intermediate of end stiles 70, including a point near the center of the door's width as seen in FIGS. 5 and 5A. Similarly, multiple center stiles 90 may be placed at any position along the width of a panel 30. When multiple center stiles 90 are used, as shown for example in FIG. 1, center stiles 90 may advantageously be substantially evenly spaced from each other and for end stiles 70. Center stile 90, like end stile 70, may have a box-like stile body 91 extending vertically between the top and bottom 31, 32 of panels 30 (FIGS. 6A and 6B). Like end stile 70, center stile 90 may be provided with a profile similar to the first and second joint surfaces 41, 42. Likewise, center stile 90 may be sized to accommodate the insulating material 60 such that the layer of insulating material 60 may be inserted between front facer 36 and center stile 90. The center stile 90 may further be provided with a receiver, generally indicated with the numeral 95, similar to receiver 75, that receives various components 80 of the door system 10 for transport and storage or stowage. As shown, the receiver 95 may include a recess 96 that is aligned with receivers 75 formed on the end stiles 70, such that elongate linear members that span the width of door 14 may be mounted in recesses 76, 96 (see FIGS. 5 and 5A).

In accordance with another feature of the present invention, rollers, generally indicated by the numeral 100 in FIG. 1A, supported on the door 14 are positioned outside of the end stiles 70. Rollers 100 generally include a roller shaft 102 and wheel 103 coupled to the shaft 102 and freely rotatable thereon. The end stiles 70 may support rollers 100, and, thus, be provided with openings 101 for receipt of roller shafts 102. The openings 101 may be formed near the vertical extremities of end stiles 70 of each panel 30 near the interface 38 of adjacent panels 30. The bottom panel 32 may be provided with roller 100 at the bottom of its end stile 70, as described below. As shown, multiple openings 101, or a single opening that accommodates multiple roller positions, such as a slot, may be formed in end stiles 70 such that the roller may be moved on end stile 70 to accommodate the angularity of vertical track sections 18, 18 relative to vertical jambs 12, 12 commonly employed in the art.

A roller carrier, generally indicated by the numeral 110, may be fitted within end stile 70 to secure the roller 100 thereon. Referring to FIGS. 1A, 2 and 2A, the roller carrier 110 may include a hollow, block-like member or roller block 111 having an exterior surface 112 that generally conforms to the interior 113 of end stile 70 and may be inserted within the stile body 71 as indicated in FIG. 1A. The roller block 111 shown in FIG. 2, for example, has a front wall 115 and a top wall 116 joined by an upwardly and rearwardly sloping face 117, which provides a forward clearance at 118 for shoulder 44. Similarly, a rearward clearance at 119 is provided by an arcuate transition 120 between the top wall 116 and a rear wall 122 of roller block 111. Roller block 111 may be open at its ends 123, 123 and define one or more openings 124 in which a roller 100 may be received. For example, as shown in FIG. 2A, a row of roller receiving bores 125 may be formed in the roller carrier 110 to provide multiple positions for receipt of the roller 100. In this manner, the centers B (FIG. 2A) of bores 125 may be spaced in two dimensions within a plane extending perpendicular to the front surface 36 of facer 35. For example, as shown in FIG. 2A, bores 125 may be located along a diagonal line, connecting their centers B, extending between the top and bottom walls 116, 126. It will be appreciated that bores 125 may be located at other positions relative to walls 112 and may be variably angularly aligned relative to each other, as well. The walls of bores 125 may be of any material including metals and plastics. Similarly, roller carrier 110 may be made of any suitable material capable of sustaining wind loads, such as metals and plastics. For example, roller carrier 110, shown in the FIGS. 2 and 2A, is constructed of a plastic material, which advantageously helps to reduce noise that ordinarily is emitted from conventional steel rollers and carriers. It will be appreciated that a plastic insert may be used with a metal roller carrier 110 to achieve similar noise reduction.

The end stile 70 is provided with one or more openings 101 corresponding to the roller receiving bores 125. As mentioned, the roller carrier 110 may take on the form of a generally block-like member 111 sized to conform to the interior 128 at the upper extremity of an end stile 70 and place bores 125 in registry with openings 101. Rollers 100 are inserted through openings 101 and into the bores 125. During assembly of the door system 10, after the rollers 100 are inserted, panels 30 may be stacked between vertically extending track portions 18 that receive rollers 100. Since rollers 100 hold panels 30 in position, the need for an aggressive fit between the panels 30 is eliminated. Further, panel alignment is maintained by rollers 100, allowing easy attachment of door hinges.

Hinge assemblies, generally indicated by the numeral 130 in FIGS. 1 and 1A, pivotally connect panels 30, and may include any commercially available hinge that acts to help support and pivot the panels 30 as they travel from the vertical, closed position to the horizontal, open position. Preferably, as shown in FIGS. 1A, 2, 2A, 3 and 3A, each hinge assembly 130 may include a single leaf hinge 131. The single leaf hinge 131 is a unitary member, which may have any shape capable of coupling adjacent panels, and a pivot point located to allow proper articulation of the panels 30. Single leaf hinge 131 may, as shown, take the form of a generally L-shaped member having a first leg 132 extending adjacent the rear tabs 59 and 47 of the panel 30 and shorter second leg 133 extending inward toward the front face 36 of the panel 30. The shorter leg 133 may have an end 134 that interacts with the door 14 in a pivoting fashion, as described more completely below. Referring to FIG. 2, second leg 133 of hinge leaf 131 may extend toward the front surface 36 of facer 35 and attach to the door 14 beneath the interface 38 of adjacent panels 30A and 30B. Second leg 133 may be oriented at an angle, which may be perpendicular (FIG. 2A), oblique, or acute (FIG. 3A) relative to first leg 132. The end 134 of second leg 133 may be pivotally attached to panel 14, as by a pin 136, shown in FIG. 3A, or an end receiver assembly, generally indicated by the numeral 135 in FIG. 2, and described more completely below.

As shown in FIG. 2A, end-receiving assembly 135 may include a boss 137 that extends toward the front face 36 of facer 35. An arcuate slot, generally indicated by the numeral 140, is formed adjacent the boss 137 to receive end 134 of hinge leaf 131. Boss 137 may be downwardly offset relative to the roller carrier 110 to provide clearance for the rotation of second leg 133 as the end 134 rotates about the boss 137. Slot 140 extends circumferentially about a portion of boss 137 and has a radius complementary to that of end 134, such that end 134 is permitted to rotate freely about boss 137. The slot 140 has a length sufficient for pivoting of the hinge 130 through the range of motion necessary for proper movement of the door panels 30 between the open and closed positions. For example, as shown in FIG. 2A, the operating range of a panel may include travel from the vertical aligned position to a fully angled position 30'. To facilitate installation, slot 140 may be provided with additional clearance at 145 that allows the hinge leaf 131 to rest in a position at a greater angle outside the operating range of motion for the hinge leaf 131 during operation. In this way, the hinge leaf 131 may be left to rest in an inoperative position where the hinge leaf 131 will not interfere with the installation of the door 14.

Figure 3A:
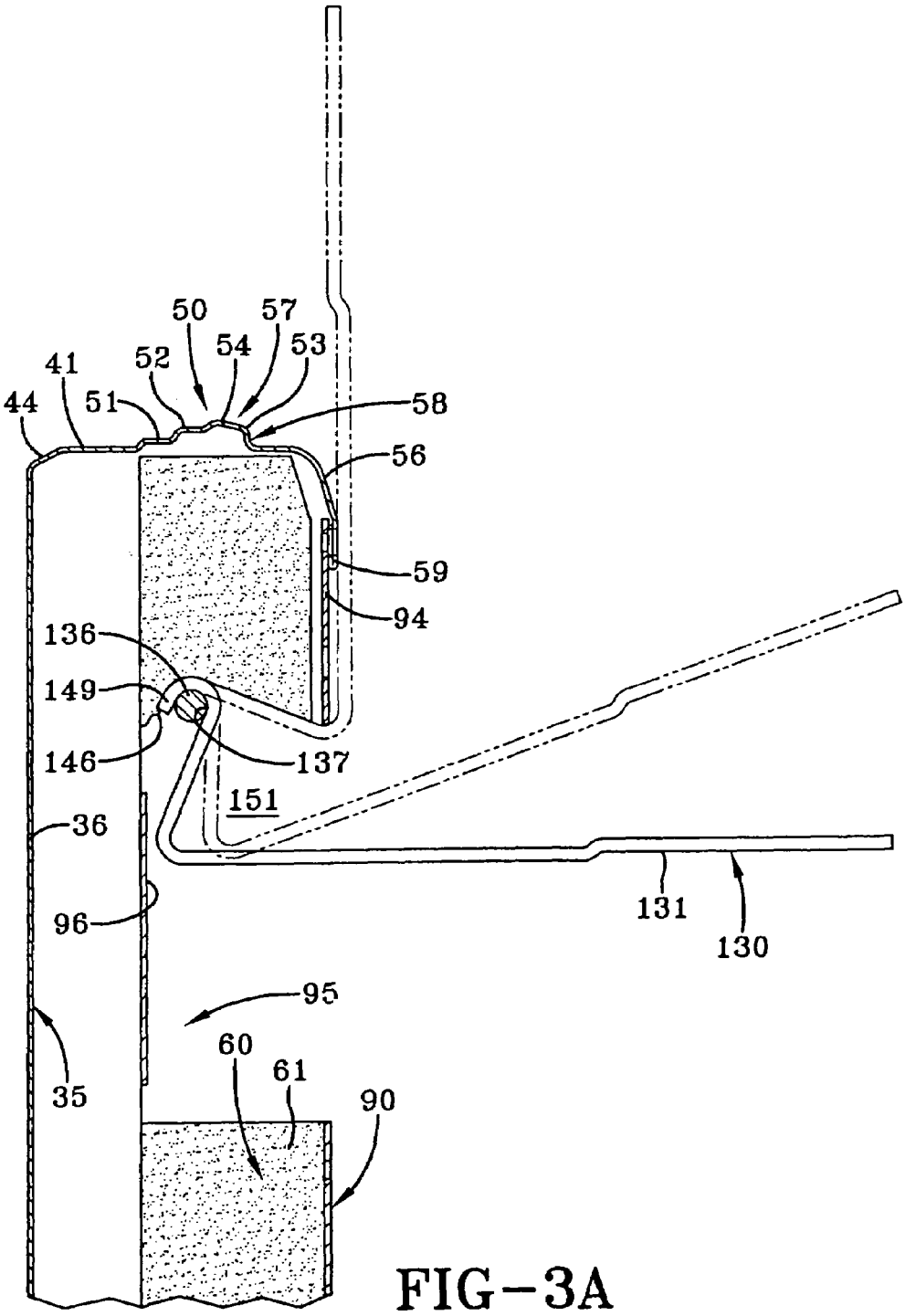
FIG. 3A is a fragmentary sectional side elevational view similar to FIG. 3 depicting further details of the hinge assembly including a position of the hinge prior to attachment to an adjacent section and positions delineating the normal range of hinge motion during operation of the door in chain lines.

Referring to FIG. 3A, end 134 is curled or made cylindrical to define a pin-receiving bore 137 and sized such that the end 134 is freely rotatable on the pin 136. When using a pin 136 to pivotally attach end 134, a projection 146 that interacts with end 134 may be used to hold hinge 130 in an inoperative position, as described with respect to the end receiver assembly 135. For example, as shown in FIG. 3A, projection 146 extends outwardly from a surface 147 on center stile 90 adjacent end 134. End 134, as discussed above, is curled to define a bore and may be left open at one end to define a gap 148 in which the projection 146 may be received. Alternatively, the gap 148 may be formed in the surface of the end 134. Gap 148 is located such that when the hinge leaf 131 is in the inoperative position, which may correspond to a position where the first leg 132 of hinge leaf 131 is in a generally perpendicular position relative to the front surface 36 of facer 35, the tip 149 of end 134 contacts projection 146. In this position, projection 146 impedes rotation of end 134 such that hinge leaf 131 remains in the inoperative position until a force is applied to cause rotation of the hinge leaf 131. The force required may be minimal, such that the user may manually disengage projection 146 by manually rotating hinge leaf 131. To that end, projection 146 may be provided with tapered surfaces, extend only a small extent, or be made of a somewhat flexible material.

With second leg 133 pivotally attached, as by sliding end 134 laterally over the pin 136 or boss 137, first leg 132 is attached to the adjacent panel 130 to couple adjacent panels 30 to each other. As shown in FIGS. 2, 2A, 3 and 3A, for example, first leg 132 of hinge leaf 131 extends upwardly a sufficient extent to allow attachment of the first leaf 132 to a superjacent panel 30A. To provide clearance for the rear tabs 47, 59 of adjacent panels, second leg 132 may be initially rearwardly offset as it extends from second leg 133, relative to stiles 70, 90, to provide clearance for the rear tabs 47, 59 of facers 35. Once beyond tabs 47, 47, the first leg 132 may jog inwardly such that it fits flush against stiles 70, 90. First leg 132 may be conventionally attached to stiles 70, 90 with fasteners 150 or suitable adhesives.

As best shown in FIGS. 2A and 3A, a clearance area 151 may be provided below second leg 133 to facilitate rotation of the hinge leaf 131, during operation of the door 14. As best shown in FIGS. 2A and 3A, for example, rotation of the hinge leaf 131 causes second leg 133 to rotate in a clockwise fashion toward the stile 70, 90. Clearance area 151 is provided below hinge leaf 131 such that second leg 133 may rotate as the door 14 moves from a generally vertical, closed position to a generally horizontal, open position. If storage receivers 75, 95 are provided and used, components 80 will have been removed from storage receivers 75, 95 prior to operation of door 14, and storage receivers 75, 95 may be used for this purpose. In that regard, as shown in FIGS. 2 and 3, the storage receivers 75, 95 may be located immediately below the hinge leaf 131.

It is to be appreciated that the configuration of the joint assemblies 41, 42 and the location of the pivot axis of hinge assemblies 130 combine to define the spacing between panels 30A and 30B and particularly nose 45 and second joint member 42 during the entire operating range of the angular articulation between adjacent panels. The spacing may be dimensionally controlled to at all times remain within approximately 0.2 inch such that a person's fingers cannot be inserted therein. Strength of the panels 30 at joint members 41, 42 is enhanced by the fact that second joint member 42 and particularly the arc 48 is of a relatively large radius and by the fact that the majority of the first joint member 41 is oriented substantially perpendicular to the front surface 36.

To facilitate opening and closing of the door 14, a counterbalance system 15 is used in a manner conventional in the art as seen in FIG. 1. The counterbalance system 15 may include a cable C (FIG. 4) that is attached to the door in the counterbalance system 15, such that the counterbalance system 15 transmits a variable counterbalancing force through the cable C to the door 14. While cable C may be attached in any manner common in the art, a cable retainer, generally indicated by the numeral 155 in FIG. 4, may be provided for this purpose. Cable retainer 155 may be located on the bottom panel of the door 14 and may include an annular flange 156 displaced outward from the end of end stile 70 to form a spool-like member about which the cable C may pass in a U-turn fashion. The end 157 of the cable C may then be secured, as by forming a loop about cable retainer 155 and securing the end 157 of cable C with a clamp 158. In this way, tension applied to cable C is delivered to the door 14 at bottom panel 32 via cable retainer assembly 155. As an alternative, cable C may be indirectly attached to the cable retainer 155 by way of a link, generally indicated by the numeral 160, attached to the cable retainer 155 and freely rotatable thereon, at a first end 161 and attached to the cable at a second end 162, as by a shoulder pin 163. In this way, some rotation of the link 160 will occur prior to application of tension to the cable retainer 155.

As a further alternative, cable retainer 155 may be provided with a tubular bore 165 (FIGS. 1A and 4) adapted to receive a roller shaft 102. Bore 165 may extend axially inward from flange 156 and be insertably received within an opening 101 in end stile 70. Tubular bore 165 may be adapted to receive a roller shaft 102, and, thus, the bottom panel 30 of door 14 may be provided with a roller 100 mounted in conjunction with the cable retainer 155, as shown in FIG. 1A.

To protect the bottom panel of door 14 and effect a seal, an astragal assembly, generally indicated by the numeral 170, may be attached to the bottom 32 of the lowermost panel 30. As best shown in FIG. 4, astragal assembly 170 may include a mounting bracket 171 attached at the rear surface 174 of stiles 70, 90. Bracket 171 may include a receiver portion, generally indicated by the numeral 175, which has a fastening clip member 176 that extends rearwardly of the door 14 just inside the vertical plane of rear tab 47 of facer 35. From the bottom of clip member 176 receiver portion 175 extends toward the front surface 36 of facer 35, along a line perpendicular to front surface 36, beneath the bottom surface 32 of panel 30, closing the panel 30 and protecting the exposed second joint surface 42. Receiver portion 175 may include one or more grooves 179,179 to which a sealing member, generally indicated by the numeral 180, is attached in a conventional manner. For example, the grooves 179, 179 may be spaced, generally horseshoe-shaped notches in which flexible tabs 181 carried on sealing member 180 are insertably received. As shown, sealing member 180 includes a generally U-shaped wall 185 that extends downwardly to cushion contact and effect sealing at the bottom of the door 14 with a floor, the ground or the like.

Thus, it should be evident that the door system disclosed herein carries out one or more of the objects of the present invention set forth above and otherwise constitutes and advantageous contribution to the art. As will be apparent to persons skilled in the art, modifications can be made to the embodiments disclosed herein without departing from the spirit of the invention, the scope of the invention herein being limited solely by the scope of the attached claims.

The invention claimed is:

1. A sectional door movable between a closed vertical position and an open horizontal position comprising, a plurality of panels having a front facer and a rear surface, first and second joints spaced and joined by said front facer and integrally interconnecting said front facer and said rear surface, said first and second joints being hinged to permit pivotal movement between adjacent of said panels and being matingly engaged in the closed vertical position, said first joint having primarily substantially planar surfaces oriented substantially perpendicular to said front facer and said second joint being a substantially curvilinear surface, whereby a strong pinch resistant construction of said door is provided.

2. The sectional door of claim 1, wherein said first joint has a raised portion located intermediate said front facer and said rear surface of said panels, said raised portion contacting said second joint to bear a portion of the weight of an adjacent one of said panels.

3. The sectional door of claim 2, wherein said raised portion tangentially contacts said surface of said second joint when said door is in the closed vertical position.

4. The sectional door of claim 1 , wherein said second joint has a projecting nose which is spaced no more than 0.2 inch from said first joint during movement between the closed vertical position and the open horizontal position.

5. The sectional door of claim 1, wherein said surface of said second joint is a generally concave surface receiving said first joint.

6. The sectional door of claim 1, wherein said second joint is substantially an arc of a circle.

7. The sectional door of claim 1 further comprising, a downwardly extending nose joining said front facer of the door to said second joint, and wherein said first joint defines an offset portion near said front facer of said panels adapted to receive said nose when said door is in the closed vertical position.

8. The sectional door of claim 7 further comprising, a heel portion formed on said second joint near said rear surface of said panels, and a recessed offset formed on said first joint defining a clearance between said first and second joints near said rear of said panels.

9. The sectional door of claim 1, wherein said first joint is integrally formed on a top surface of said panels and said second joint is integrally formed on a bottom surface of said panels.

10. The sectional door of claim 1, wherein said panels have end stiles receiving roller carriers supporting rollers, said roller carriers being constructed of a plastic material.

11. The sectional door of claim 10 further comprising, a hinge receiver formed on said roller carriers, and a hinge having a first end pivotably received within said hinge receiver and a second end attached to an adjacent one of said panels, whereby said hinge pivotally connects adjacent of said panels.

12. The sectional door of claim 11, wherein said hinge receiver includes an arcuate slot and said first end of said hinge is arcuate such that said first end of said hinge travels within said arcuate slot during pivotal movement of said hinge.

13. The sectional door of claim 1, wherein said second joint has a large radius curved surface.

14. A sectional door movable between a closed vertical position and an open horizontal position comprising, a plurality of adjacent panels having a facer integrally forming a front surface, first and second joint members extending rearwardly of said front surface, and rear surfaces extending from said joint members and substantially paralleling said front surfaces, hinges connecting adjacent panels for articulation when moving between the open horizontal position and the closed vertical position with said first joint member of one of said panels in mating engagement with said second joint member of an adjacent of said panels, said first joint member having primarily substantially planar surfaces oriented substantially perpendicular to said front surface, and said second joint member having a substantially curvilinear surface, whereby said panels provide a strong pinch resistant construction.

15. The sectional door of claim 14, wherein said second joint member is substantially an arc of a circle.

16. The sectional door of claim 15, wherein said arc has a large radius.

17. The sectional door of claim 14, wherein the junctures of said second joint member with said front surface and said rear surface lie on a line substantially perpendicular to said front surface.

18. The sectional door of claim 14, wherein said first joint member has a raised planar surface located substantially intermediate said front surface and said rear surfaces and contacts said second joint, said first joint member having a plurality of planar tiers between said front surface and said raised planar surface.

19. The sectional door of claim 14, wherein said panels have stiles mounting said hinges and extending between said front surface and said rear surfaces.

20. The sectional door of claim 19, wherein said stiles include end stiles and at least one center stile, said end stiles receiving and supporting rollers.

* * * * *